US006894444B2

(12) United States Patent
Nakayama et al.

(10) Patent No.: US 6,894,444 B2
(45) Date of Patent: May 17, 2005

(54) COLOR CATHODE RAY TUBE AND METHOD OF MANUFACTURING THE SAME

(75) Inventors: Takeshi Nakayama, Fukaya (JP); Takuya Mashimo, Kumagaya (JP); Tohru Takahashi, Osato-gun (JP); Hiroyuki Oda, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/761,246

(22) Filed: Jan. 22, 2004

(65) Prior Publication Data

US 2004/0212328 A1 Oct. 28, 2004

Related U.S. Application Data

(63) Continuation of application No. PCT/JP03/06416, filed on May 22, 2003.

(30) Foreign Application Priority Data

May 22, 2002 (JP) ..... 2002-147916

(51) Int. Cl.[7] ..... G09G 1/04

(52) U.S. Cl. ..... 315/366; 315/402; 315/422; 315/421

(58) Field of Search ..... 315/366, 375, 315/376, 368.11, 368.15; 313/402, 403, 408, 411, 413, 415, 421, 422, 429, 440, 461, 477 R

(56) References Cited

U.S. PATENT DOCUMENTS 6,218,772 B1 * 4/2001 Shimizu et al. ..... 313/402
6,455,993 B1 * 9/2002 Ito ..... 313/408
6,608,454 B2 * 8/2003 Shimizu et al. ..... 315/366

FOREIGN PATENT DOCUMENTS

EP 1220274 A2 7/2002
JP 8-293266 A 11/1996
JP 2001-297708 A 10/2001

* cited by examiner

*Primary Examiner*—Haissa Philogene
(74) *Attorney, Agent, or Firm*—Oblon, Spivak, McClelland, Maier & Neustadt, P.C.

(57) ABSTRACT

A shadow mask is formed by lapping a main mask and an auxiliary mask on each other. The auxiliary mask includes a porous portion having electron beam passage holes, nonporous portions situated individually at the opposite ends of the porous portion, a pair of skirt portions extending individually from the nonporous portions and lapped on the skirt portion of the main mask, and second beads formed individually on the skirt portions and overlapping first beads of the main mask. The height or width of the first beads and the second beads in a superposed portion in which the main mask and the auxiliary mask are lapped on each other is differentiated from that of the beads in non-superposed portions outside the superposed portion.

8 Claims, 5 Drawing Sheets

COLOR CATHODE RAY TUBE AND METHOD OF MANUFACTURING THE SAME

CROSS-REFERENCE TO RELATED APPLICATIONS

This is a Continuation Application of PCT Application No. PCT/JP03/06416, filed May 22, 2003, which was not published under PCT Article 21(2) in English.

This application is based upon and claims the benefit of priority from the prior Japanese Patent Application No. 2002-147916, filed May 22, 2002, the entire contents of which are incorporated herein by reference.

BACKGROUND OF THE INVENTION

1. Field of the Invention

The present invention relates to a color cathode ray tube provided with a shadow mask and a method of manufacturing the same.

2. Description of the Related Art

In general, a color cathode ray tube comprises an envelope and a substantially rectangular shadow mask. The envelope includes a panel that has a phosphor screen on its inner surface. The shadow mask is opposed to the phosphor screen in the envelope. The shadow mask has an effective surface that faces the phosphor screen, and a number of apertures are formed as electron beam passage apertures in a given array in the effective surface. The shadow mask has a function to screen three electron beams that are emitted from an electron gun by means of the apertures so that the electron beams are incident upon a three-color phosphor layers that constitute the phosphor screen.

The effective surface of the shadow mask constructed in this manner is a curved surface shaped corresponding to the shape of the inner surface of the panel. It includes a porous portion that is formed having a number of apertures in a given array and a nonporous portion that is located around the porous portion and has no apertures. The shadow mask has a skirt portion that extends perpendicularly from the peripheral edge of the nonporous portion. Beads are formed on the skirt portion.

The shadow mask is manufactured by press-forming a flat mask base that is formed having specific apertures. In this case, the mask base is first placed between a knockout and a die of a pressing machine. Then, the peripheral portion of the mask base is held by a blank holder and the die, whereby the mask base is fixed. After the mask base is then projected into a specific curved form by means of a punch, the blank holder and the die are separated from each other to expose the peripheral portion of the mask base.

Then, the knockout and the punch are moved downward so that the peripheral portion of the mask base is drawn into a space between the punch and the die. By doing this, the peripheral portion is bent substantially squarely to form the skirt portion. Thereafter, all the molds are restored to their respective original positions, and the formed shadow mask is taken out. The beads that are formed on the skirt portion have a function to pull a porous portion forming portion of the mask base in the radial direction, thereby smoothing out wrinkles from the mask base. They also serve to facilitate plastic deformation and enhance the shape retention of the formed shadow mask.

Flat tubes have recently been spread as modern color cathode ray tubes. In these tubes, the outer surface of a panel is substantially flat, having a curvature radius of 100 m or more. Normally, a porous portion of a shadow mask that is formed having electron beam passage apertures is shaped corresponding to the shape of the inner surface of the panel. In a flat tube, therefore, the effective surface of the shadow mask is substantially flat, having a curvature smaller than that of the effective surface of the shadow mask of the conventional color cathode ray tube.

If the curvature of the effective surface of the shadow mask is thus small, it is hard for the shadow mask to maintain its curved mask surface resisting its own weight or external force. Thus, if the curvature of the effective surface is reduced, the retention of the curved mask surface (hereinafter referred to as curved mask surface strength) lowers. If the curved mask surface strength is low, the effective surface of the shadow mask is inevitably deformed by a very small external force during manufacture or transportation. In this case, the distance between the inner surface of the panel and the electron beam passage apertures of the shadow mask varies, so that the electron beams emitted from the electron gun fail to land on desired phosphor layers, thereby causing a color drift.

Although the lowering of the curved mask surface strength never renders the shadow mask deformed, moreover, it inevitably causes the effective surface of the mask to be easily resonated by vibration such as a voice when the mask is incorporated in a TV set. Thus, unwanted gradation is bound to appear on the picture.

BRIEF SUMMARY OF THE INVENTION

The present invention has been contrived in consideration of these circumstances, and its object is to provide a color cathode ray tube, which is furnished with a shadow mask having adequate curved mask surface strength and enjoys a satisfactory image quality level, and a method of manufacturing the same.

A color cathode ray tube according to an aspect of this invention comprises: a panel having a phosphor screen on an inner surface thereof; an electron gun which emits electron beams toward the phosphor screen; and a substantially rectangular shadow mask located opposite the phosphor screen inside the panel and having a major axis and a minor axis extending at right angles to each other and to a tube axis.

The shadow mask includes a main mask opposed substantially to the whole area of the phosphor screen and having a number of electron beam passage apertures and an auxiliary mask fixedly lapped on the main mask in a region near the minor axis and having a plurality of electron beam passage apertures corresponding to a part of the phosphor screen.

The main mask includes an effective portion formed having the electron beam passage apertures, a nonporous portion situated around the effective portion, a skirt portion extending from the nonporous portion, and first beads located substantially covering the whole circumference of the skirt portion.

The auxiliary mask includes a porous portion having the electron beam passage apertures, nonporous portions continuous individually with the opposite ends of the porous portion in the direction of the minor axis, a pair of skirt portions extending individually from the nonporous portions and superposed on the skirt portion of the main mask, and second beads formed individually on the skirt portions and situated overlapping the first beads of the main mask. The height or width of the first and second beads on the main mask and the auxiliary mask in a superposed portion in which the main mask and the auxiliary mask overlap each other is different from that of the beads in non-superposed portions outside the superposed portion.

A method of manufacturing a color cathode ray tube according to another aspect of this invention comprises: preparing a flat first mask base for the main mask including an effective portion having a large number of electron beam passage apertures and a flat second mask base for the auxiliary mask including an effective portion having a number of electron beam passage apertures; lapping the second mask base on a region containing the minor axis of the first mask base; fixing the lapped first and second mask bases to each other after positioning the first and second mask bases with respect to each other; press-forming the fixed first and second mask bases into a given shape with the respective peripheral portions of the first and second mask bases held to form the first and second beads on the respective peripheral edge portions of the first and second mask bases, thereby forming the shadow mask having the main mask and the auxiliary mask; and differentiating the height or width of the beads in a superposed portion between the main mask and the auxiliary mask from that of the beads in non-superposed portions in forming the beads.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

A color cathode ray tube according to an embodiment of this invention will now be described in detail with reference to the drawings.

Figure 1:
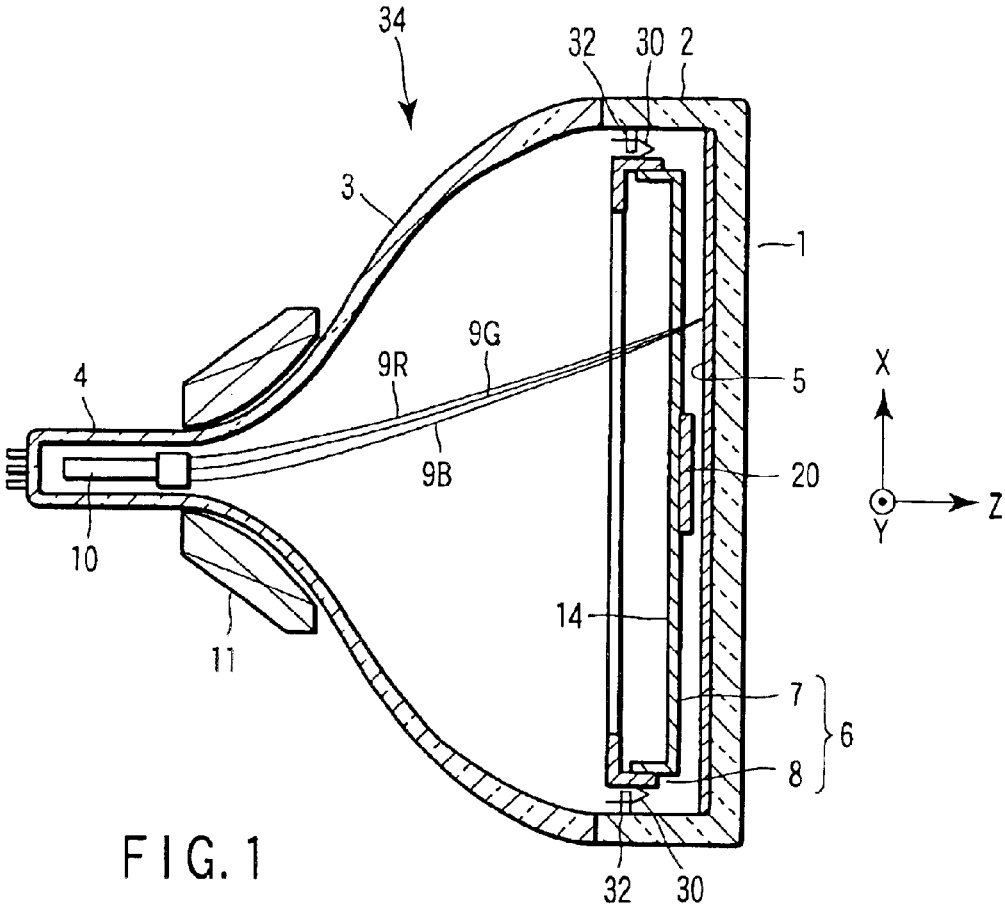
FIG. 1 is a sectional view containing the major axis of a color cathode ray tube according to an embodiment of this invention.
Figure 2:
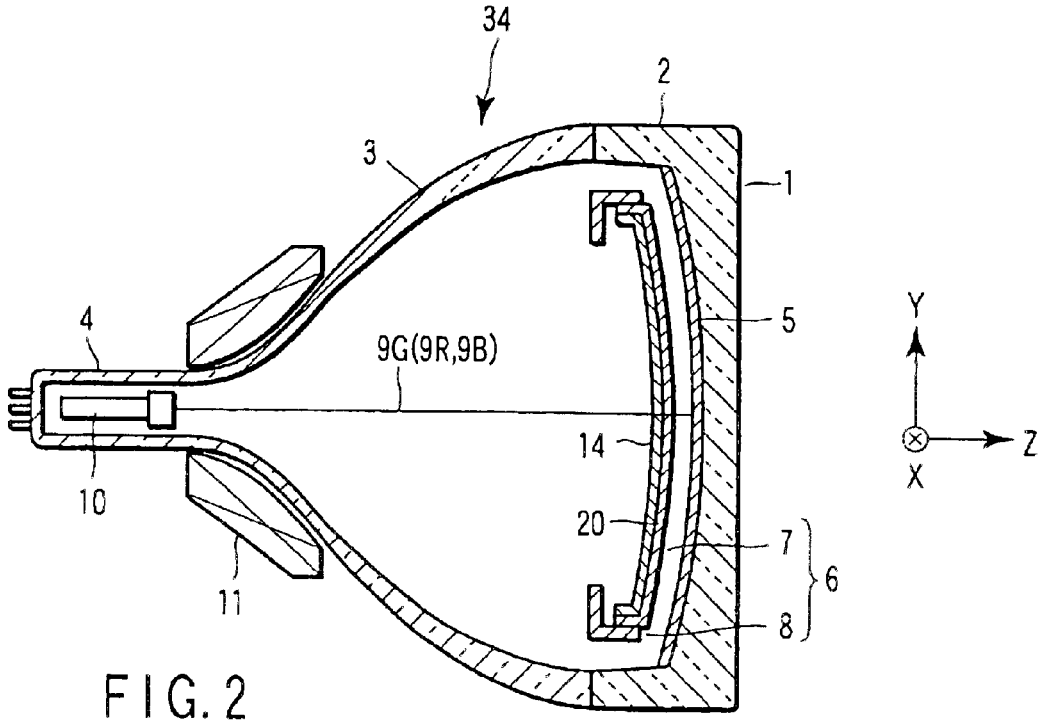
FIG. 2 is a sectional view containing the minor axis of the color cathode ray tube.
Figure 3:
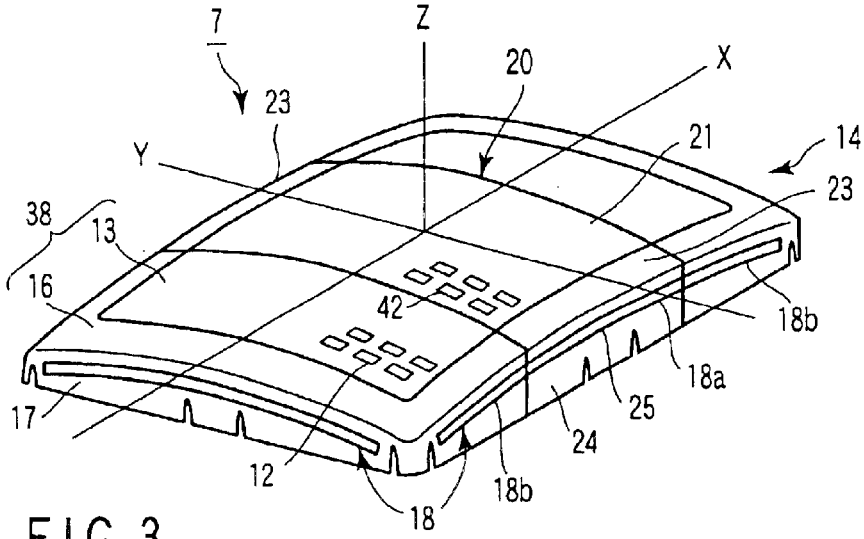
FIG. 3 is a perspective view showing a shadow mask in the color cathode ray tube.
Figure 4:
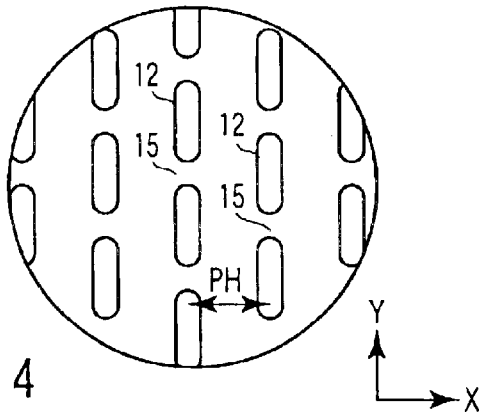
FIG. 4 is a plan view showing electron beam passage apertures of the shadow mask.
Figure 5:
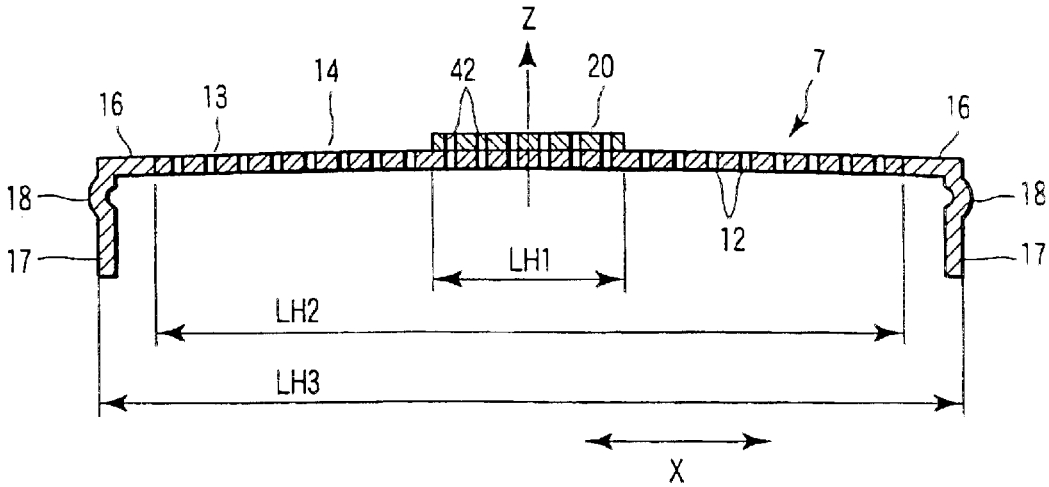
FIG. 5 is a sectional view of the shadow mask taken along its major axis.
Figure 6:
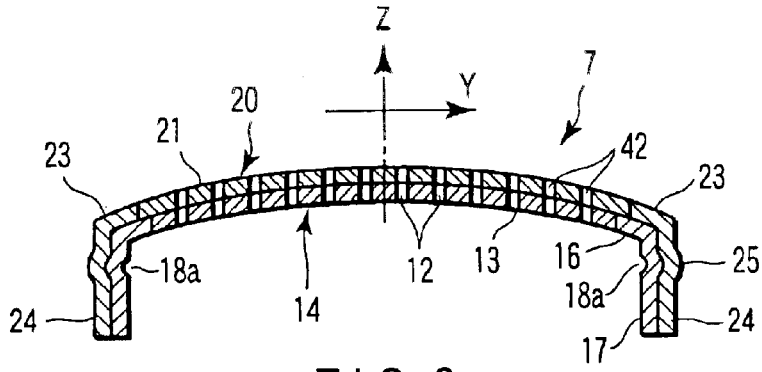
FIG. 6 is a sectional view of the shadow mask taken along its minor axis.

As shown in FIGS. 1 and 2, a color cathode ray tube comprises an envelope 34 that is formed of glass. The envelope 34 includes a rectangular panel 1 having a skirt portion 2 on its peripheral edge portion, a funnel 3 bonded to the skirt portion 2 of the panel 1, and a neck 4 extending from a small-diameter portion of the funnel 3. A phosphor screen 5 is formed on the inner surface of the panel 1. The envelope 34 has a tube axis Z that passes through the respective centers of the panel 1 and the neck 4, a major axis (horizontal axis) X that extends at right angles to the tube axis, and a minor axis (vertical axis) Y that extends at right angles to the tube axis and the major axis.

In the case of a 32-inch wide-type color cathode ray tube having a picture aspect ratio of 16:9 and a picture effective diameter of 76 cm, for example, the outer surface of the panel 1 is substantially flat, having a curvature radius of 100,000 mm. The inner surface of the panel 1 is cylindrical, having a curvature radius of about 7,000 mm on and along the X-axis and a curvature radius of about 1,500 mm on and along the Y-axis.

A shadow mask structure 6 as a color selecting electrode is arranged in the envelope 34 so as to face the phosphor screen 5. The shadow mask structure 6 has a shadow mask 7 and a mask frame 8 in the form of a rectangular frame having an L-shaped cross section. A number of apertures as electron beam passage apertures are formed in the shadow mask 7. The peripheral portion of the shadow mask 7 is fixed to the mask frame 8. The shadow mask structure 6 is supported on the inside of the panel 1 with elastic supports 30 on the sidewall of the mask frame 8 anchored individually to stud pins 32 that are embedded in the skirt portion 2 of the panel 1. The electron beam passage apertures in the shadow mask 7 are formed in a rectangular or circular depending on the way of use.

Located in the neck 4 is an electron gun 10 that emits three electron beams 9R, 9G and 9B that are arranged in line on the major axis X. In the color cathode ray tube described above, the electron beams 9R, 9G and 9B emitted from the electron gun 10 are deflected by means of a deflection yoke 11 that is mounted on the outside of the funnel 3. They are used to scan the phosphor screen 5 horizontally and vertically with the aid of the shadow mask structure 6. Thus, phosphor layers emit light to display an image.

The following is a detailed description of the configuration of the shadow mask 7. As shown in FIGS. 3 to 6, the shadow mask 7 is substantially rectangular as a whole. It has a major axis X and a minor axis Y that correspond individually to those of the envelope, and a tube axis Z passes through the center of the shadow mask. The shadow mask 7 comprises a main mask 14 and an auxiliary mask 20 that is attached to a part of the main mask in an overlapping manner, thus partially having a dual structure.

The main mask 14 is provided integrally with a substantially rectangular principal mask surface 38 and a skirt portion 17. The principal mask surface 38 is opposed to the inner surface of the panel 1 and has a curved surface in a given shape. The skirt portion 17 extends in the direction of the tube axis Z from the peripheral edge of the principal mask surface 38 toward the electron gun. The principal mask surface 38 has a rectangular effective portion 13 and a nonporous portion 16 in the form of a substantially rectangular frame. The effective portion 13 has a number of apertures 12 that correspond to the whole area of the phosphor screen 5 and function as electron beam passage apertures. The nonporous portion 16 surrounds the effective portion 16 and has no apertures.

Each aperture 12 of the main mask 14 has a substantially rectangular shape, having its width in the direction of the major axis X of the effective portion 13. A number of columns of apertures are located at given array pitches PH in the direction of the major axis X. In each of the columns, a plurality of apertures 12 are arranged in a straight line in the direction of the minor axis Y of the effective portion 13 with bridges 15 between them.

Figure 7:
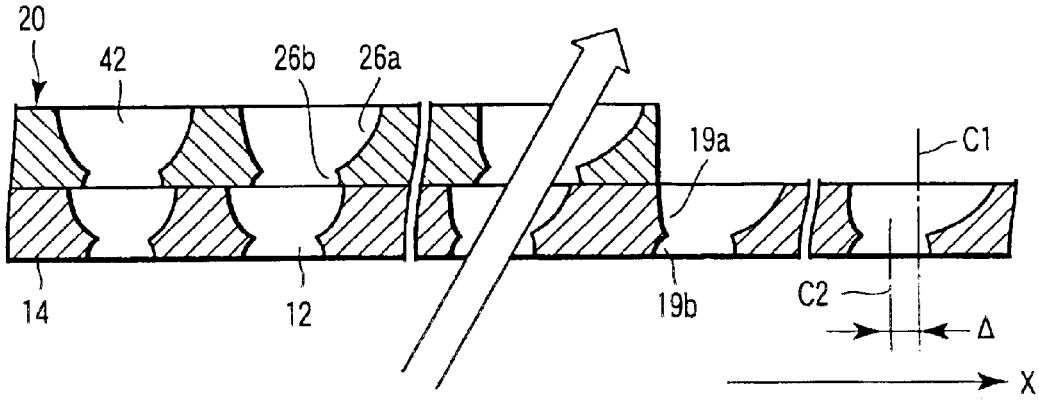
FIG. 7 is a partially enlarged sectional view showing a main mask and an auxiliary mask of the shadow mask.

As shown in FIG. 7, each aperture 12 is a communicating hole defined by a substantially rectangular larger hole 19*a* and a substantially rectangular smaller hole 19*b* that communicate with each other. The larger hole 19*a* opens in that surface of the effective portion 13 on the side of the phosphor screen 5. The smaller hole opens in that surface of the effective portion on the side of the electron gun 10. Further, each aperture 12 is formed so that a center position C1 of the larger hole 19*a* is deviated relatively from a center position C2 of the smaller hole 19*b* for an offset Δ on the peripheral side of the porous portion 13 as the periphery of the effective portion is approached. This is done in order to restrain each electron beam from running against and being reflected by the inner surface of the main mask that defines the larger hole 19*a* and from producing useless light emission on the picture plane after having passed through the smaller hole 19*b*. The larger hole 19*a* is offset with respect to the smaller hole 19*b* in both the directions of the minor axis Y and the major axis X.

The main mask 14 is formed of a metallic material, such as Invar material (Fe-36% Ni alloy) that is known as a ferrous material or low-expansion material, and has a thickness of about 0.1 to 0.25 mm.

As shown in FIGS. 3 to 7, the auxiliary mask 20 is in the form of an elongate belt, which is fixedly lapped not on the whole area of the effective portion 13 but on that region of the outer surface side of the main mask 14 or of the surface on the side of the phosphor screen 5 which contains the minor axis Y of the effective portion. The auxiliary mask 20 is arranged so that its longitudinal direction is coincident with the minor axis Y of the main mask 14.

A width LH1 of the auxiliary mask 20 in the direction of the major axis X is shorter than a length LH2 of the effective portion 13 of the main mask 14 in the major-axis direction, and its length in the direction of the minor axis Y is substantially equal to the length of the main mask 14 in the same direction along the minor axis. The auxiliary mask 20 is provided integrally with a porous portion 21, nonporous portions 23, and a pair of skirt portions 24. The porous portion 21 is provided with a number of apertures 42 that function as electron beam passage apertures. The nonporous portions 23 are situated individually at the longitudinally opposite end portions of the auxiliary mask outside the porous portion 21. The skirt portions 24 extend individually from the nonporous portions 23 toward the opposite ends.

The auxiliary mask 20 is fixed to the main mask 14 is in a manner such that its porous portion 21, nonporous portions 23, and skirt portions 24 overlap the effective portion 13, nonporous portion 16, and skirt portion 17, respectively, of the main mask. Thus, the whole area on the minor axis Y of the main mask 14 has a dual structure. That part of the shadow mask 7 in which the main mask 14 and the auxiliary mask 20 overlap each other will be referred to as a superposed region, and the parts in which the auxiliary mask is not superposed will be referred to as non-superposed regions.

Figure 8:
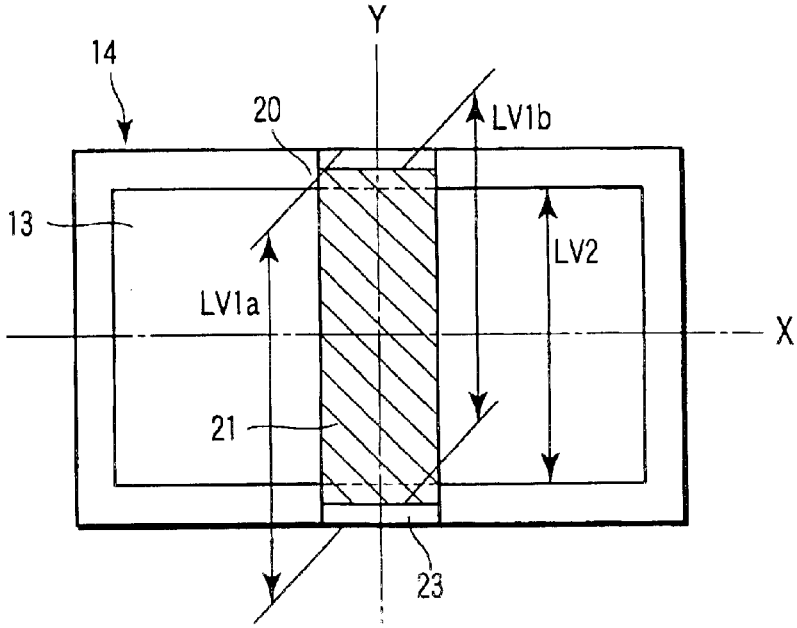
FIG. 8 is a diagram showing is a diagram showing the relation between the effective portion length of the main mask and the effective portion length of the auxiliary mask.

In the auxiliary mask 20, as shown in FIG. 8, it is desirable that a length LV1*b* of the porous portion 21 in the direction of the minor axis Y is set to be equal to or a little greater than a length LV2 of the effective portion 13 of the main mask 14. In the present embodiment, the former is greater than the latter. If dislocation in the direction of the minor axis Y is caused between the main mask 14 and the auxiliary mask 20, in this case, this dislocation can be absorbed.

Preferably, the thermal expansion coefficient of a material that forms the auxiliary mask 20 should be approximate to that of the material that forms the main mask 14. Ideally, these materials should have the same thermal expansion coefficient for the following reason. In manufacturing processes for the color cathode ray tube, the shadow mask 7 is subjected to heat of about 400° C. If the respective thermal expansion coefficients of the main mask 14 and the auxiliary mask 20 are considerably different, in this case, the region to which the auxiliary mask 20 is laminated is made bimetallic. Thus, the heat-treated shadow mask 7 is deformed or undergoes variation in mask shape if not entirely deformed.

The shadow mask 7 of which the curved surface has small curvature, as in the case of the flat tube according to the present embodiment, is liable to a color drift that is attributable to thermal expansion. Preferably, therefore, the shadow mask 7 used is a shadow mask that is formed of a material having a low thermal expansion coefficient, such as Fe—Ni alloy, Fe—Ni—Co alloy, or Fe—Ni—Cr alloy.

For the reason described above, according to the present embodiment, Invar material is used for both the main mask 14 and the auxiliary mask 20. The ratio between the width LH1 of the auxiliary mask 20 in the direction of the major axis X and a length LH3 of the main mask 14 in the direction of the major axis X is adjusted to about 1:5. Thus, the auxiliary mask 20 is fixed to a region that covers about one fifth of the length of the main mask 14 in the direction of its major axis X, thereby forming a dual structure.

As shown in FIG. 7, the auxiliary mask 20 and the main mask 14 are bonded so that the smaller hole 26*b* side of the auxiliary mask 20 and the larger hole 19*a* side of the main mask 14 are intimately in contact with each other. Preferably, each aperture 42 in the peripheral edge portion of the auxiliary mask 20 is formed in a manner such that the center of the larger hole 26*a* on the phosphor screen side is offset on the mask periphery side with respect to the center of the smaller hole 25*b* on the electron gun side. The shapes and array spaces of the apertures 42 in the porous portion 21 of the auxiliary mask 20 can be suitably set within ranges such that the shadow mask can fulfill its function. If there is no special problem, the apertures 42 are formed in the same manner as the apertures 12 of the main mask 14.

As shown in FIGS. 3 to 6, beads 18 that function as first beads are formed covering the whole circumference of the skirt portion 17 of the main mask 14. Further, beads 25 that function as second beads are formed individually on the skirt portions 24 of the auxiliary mask 20, and extend covering the overall length of the auxiliary mask in the width direction. The beads 25 of the auxiliary mask 20 overlap the beads 18 of the main mask 14, individually.

The width or height of beads 18*a* that, among the other beads 18 of the main mask 14, are situated in the superposed portion in which the main mask 14 and the auxiliary mask 20 overlap each other and of the beads 25 formed on the auxiliary mask are smaller than the width or height of beads 18*b* that are formed in the non-superposed portions. In the present embodiment, the beads 18*a* and 25 in the superposed portion are smaller than the beads 18*b* in the non-superposed portions.

Preferably, the width or height of the beads 18*a* and 25 in the superposed portion are adjusted to 0.5 to 0.9 time as great as the width or height of the beads 18*b* in the non-superposed portions.

The width or height of the beads 18*b* that are formed in the non-superposed portions of the skirt portion of the main mask 14, in the skirt portions on the long sides of the shadow mask 7, gradually increases with distance from the superposed portion, that is, from the skirt portions 24 of the auxiliary mask 20.

Since the auxiliary mask 20 is fixedly lapped on the main mask 14 to form the dual structure in this manner, the strength of the shadow mask 7, especially the strength of the region near the minor axis Y, is enhanced. In consequence, the curved surface strength of the shadow mask can be increased.

Figure 9:
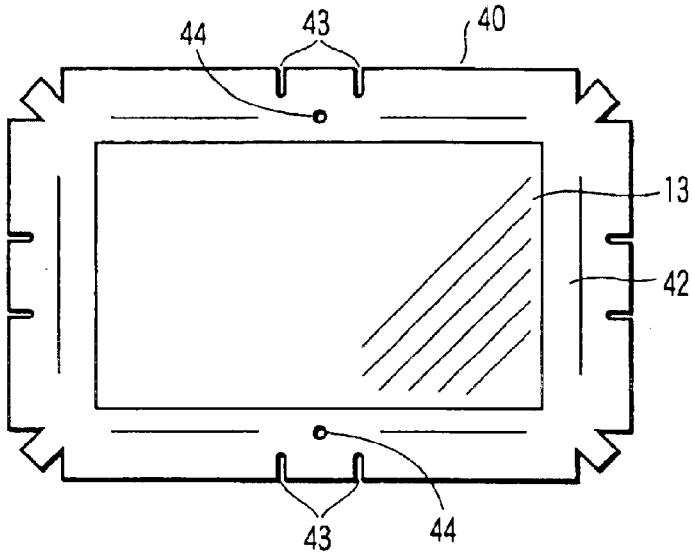
FIG. 9 is a plan view showing a mask base as a molding blank for the main mask.
Figure 10:
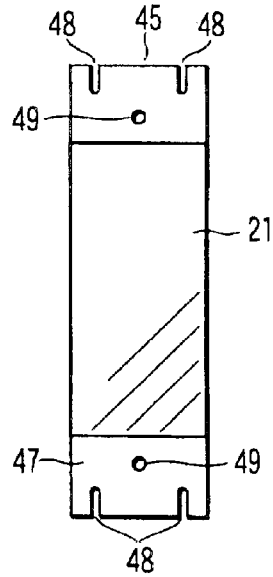
FIG. 10 is a plan view showing a mask base as a molding blank for the auxiliary mask.

The following is a description of a manufacturing method for the shadow mask 7 constructed in this manner. First, a flat mask base (first mask base) 40 for the main mask and a flat mask base (second mask base) 45 for the auxiliary mask are prepared. They are formed of a thin sheet of Invar material each and have their respective given outside dimensions, as shown in FIGS. 9 and 10. The mask base 40 has the effective portion 13 in which a number of apertures with a given diameter are arranged at given pitches by etching. Likewise, the mask base 45 has the porous portion 21 in which a large number of apertures with a given diameter at given pitches by etching. These mask bases 40 and 45 are annealed to improve press-formability.

The mask bases 40 and 45 have the effective and porous portions 13 and 21 having a number of apertures as electron beam passage apertures and nonporous portions 42 and 47 in the peripheral portions. Slits 43 and 48 and positioning holes 44 and 49 are formed in the nonporous portions 42 and 47, respectively. The positioning holes 44 and 49 are used accurately to position and fix the two mask bases 40 and 45.

In the effective and porous portions 13 and 21, as described above, the positions of the apertures may be shifted between the two mask bases 40 and 45 or the aperture diameter may be changed. It is hard, therefore, to settle the positions of the mask bases 40 and 45 with the apertures of the portions 13 and 21 as references. In this case, the two mask bases 40 and 45 can be positioned securely and easily with use of the positioning holes 44 and 49 that are previously provided in the same positions of the mask bases 40 and 45, respectively.

Figure 11:
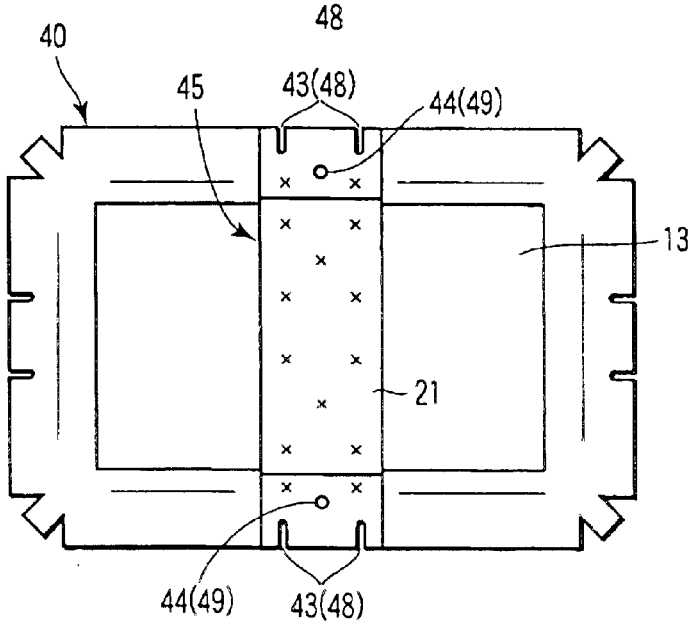
FIG. 11 is a plan view showing the mask base positioned and fixed.

Subsequently, the mask bases 40 and 45 are lapped on each other, as shown in FIG. 11. Thereafter, the two mask bases 40 and 45 are positioned with use of the positioning holes 44 and 49.

After the positioning is finished, the two mask bases 40 and 45 are fixed closely to each other. Preferably, in this case, the two mask bases 40 and 45 should be fixed intimately in contact with each other substantially in the whole area of the porous surface. They may be fixed by diffusion bonding called contact bonding, laser welding, or resistance welding. If the bases are fixed by welding, a plurality of welding points (crosses in FIG. 11) are formed in the porous portion 21 of the mask base 45.

Figure 12:
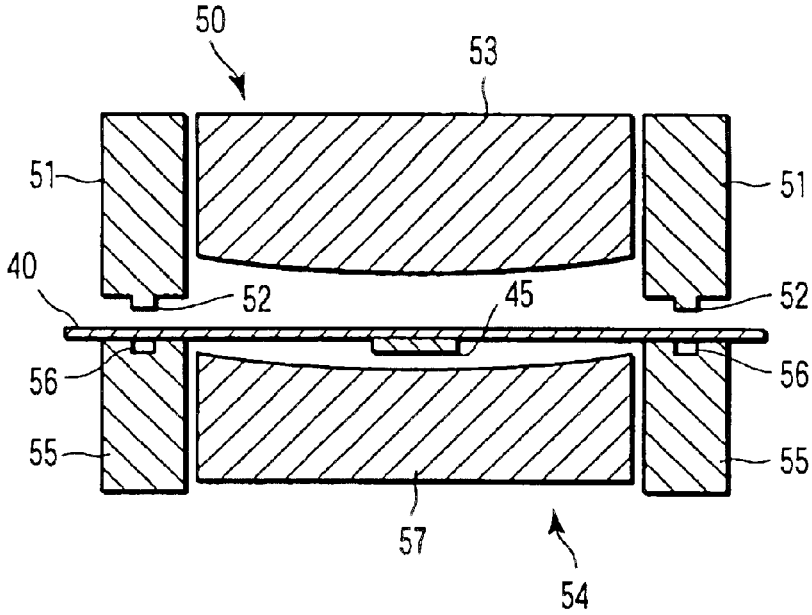
FIG. 12 is a sectional view showing two laminated mask bases placed in a pressing apparatus.

Subsequently, the mask bases 40 and 45 that are fixed to each other are press-formed simultaneously, as shown in FIG. 12. In this case, the mask bases 40 and 45 in a flat state are first positioned between a top force 50 and a bottom force 54 of a pressing apparatus. Then, a blank holder 51 of the top force 50 is lowered so that the respective peripheral portions of the mask bases 40 and 45, that is, skirt forming portions, are held between the blank holder 51 and a die 55 of the bottom force 54. The respective holding surfaces of the blank holder 51 and the die 55 are formed having bead forming parts, that is, an annular projection 52 and an annular recess 56 corresponding to the projection. The height or width of those portions of the projection 52 and the recess 56 which are situated in regions corresponding to the superposed portion of the mask bases 40 and 45 is smaller than the height or width of those portions which are situated in regions corresponding to the non-superposed portions of the mask bases. By holding the mask bases 40 and 45 by means of the bead forming parts, the beads 18 and 25 are formed on the skirt forming portions in a manner such that their height or width is smaller in the superposed portion than in the non-superposed portions.

The respective peripheral portions of the mask bases 40 and 45 are held in position with the beads 18 and 25 formed in this manner. In this state, a punch 53 of the top force 50 is lowered to project the principal surface portion of the mask into a specific curved form. Thereafter, the blank holder 51 and the die 55 are separated from each other to expose the respective peripheral portions of the mask bases 40 and 45. Then, the punch 53 and a knockout 57 are depressed so that the peripheral portions of the mask bases 40 and 45 are drawn into the gap between the die 55 and the punch 53. By doing this, the peripheral portions are bent substantially squarely to form the skirt portions 17 and 24. Then, all the molds are restored to their respective original positions, and the molded shadow mask 7 is taken out.

In the present embodiment, the two mask bases 40 and 45 are press-formed after they are fixed in the flat state. This is done in order to secure the positional accuracy of the apertures. As mentioned before, the aperture positions of the mask bases 40 and 45 must be made accurately coincident with one another. If the pressing position is dislocated as the mask bases are press-formed, the aperture positions of the mask bases are also dislocated with respect to desired positions. If an attempt is made to align the mask bases 40 and 45 with each other after these mask bases are molded into a curved form, it is hard to make the apertures of the mask bases 40 and 45 accurately coincident with one another. Since both the mask bases 40 and 45 have the curved form after the pressing, it is very hard to make their respective positions coincident with each other.

In the present embodiment, therefore, the two mask bases 40 and 45 are press-formed together after these mask bases are positioned and fixed in the flat state before they are pressed. As in the case of the manufacture of a conventional color image receiving tube, the press-formed shadow mask is attached to the mask frame after it is subjected to a mask blackening process in which an oxide film is formed on its surface.

According to the color cathode ray tube and its manufacturing method arranged in this manner, the auxiliary mask 20 can restrain deformation of the central portion of the shadow mask 7 that is most liable to deformation. In consequence, the curved mask surface strength of the shadow mask can be enhanced. Thus, the color cathode ray tube that enjoys an improved image quality level can be obtained without failing to prevent deterioration of images that is attributable to deformation or vibration of the shadow mask.

According to the shadow mask 7 constructed in this manner, moreover, the beads 18 and 25 are formed on the skirt portion 17 of the main mask 14 and the skirt portions 24 of the auxiliary mask 20, respectively. In this case, the superposed portion is thicker than the non-superposed portions at the bead forming parts, so that the tension of projected portions or drawn portions in the superposed portion can be lowered during projecting or drawing operation. In consequence, a phenomenon can be restrained such that the auxiliary mask 20 that is situated on the phosphor screen side is shifted along the minor axis Y toward the minor axis end side with respect to the main mask 14 on the electron gun side during the press-forming operation.

Further, the height or width of those parts of the beads 18 and 25 on the skirt portions 17 and 24 which are situated in the superposed portion of the shadow mask is smaller than the height or width of those parts situated in the non-superposed portions. Therefore, the tension that acts on the superposed portion of the shadow mask during the press-forming operation can be further lowered. Thus, the dislocation between the main mask 14 and the auxiliary mask 20 can be restrained further effectively.

The shift of the auxiliary mask 20 on the phosphor screen side along the minor axis Y toward the minor axis end side with respect to the main mask 14 during the press-forming operation was 66.3 $\mu$m when the beads in the superposed portion shared the height and width with the beads in the non-superposed portions. The shift was 19.7 $\mu$m when the height and width of the beads in the superposed portion was differentiated from those of the beads in the non-superposed portions, as in the case of the present embodiment. The height and width were based on comparison between mean values that were measured in a plurality of positions on the minor axis end of the auxiliary mask. Thus, according to the present embodiment, the dislocation of the main mask 14 and the auxiliary mask 20 that is attributable to the press-forming can be reduced considerably.

Since the superposed portion of the shadow mask is thicker than the non-superposed portions, moreover, the mask is a flat mask that is wrinkled little. The shape retention of the molded shadow mask is enhanced. Therefore, lowering the tension on the superposed portion is an effective measure to balance the formability between the superposed portion and the non-superposed portions, and reducing the height or width of the beads in the superposed portion exerts no bad influence upon the formability.

Preferably, as mentioned before, the beads 18 and 25 that are provided in the non-superposed portions on the long sides of the shadow mask have a shape such that their respective heights or widths increase with distance from the superposed portion. If the beads are shaped in this manner, there is no possibility of the formability of the shadow mask suddenly changing at the boundaries between the superposed portion and the non-superposed portions. Thus, the curved surface of the shadow mask can be prevented from being deformed as it is press-formed, so that the shadow mask can be formed with high accuracy.

If the shadow mask 7 is applied to a 32-inch wide-type color cathode ray tube having a picture aspect ratio of 16:9 and a picture effective diameter of 76 cm, for example, the height of the beads 18 that are formed on the skirt portion 17 of the main mask 14 is fixed to 1 mm throughout the circumference, and the height of the beads 25 of the auxiliary mask 20 is also 1 mm. In the superposed portion, the width of the beads 18 and 25 is 5 mm. In the non-superposed portions, the width of the beads 18*b* that are situated on the long sides of the shadow mask is 5.5 mm at a point at a distance of 100 mm from the center of each long side. The width is 6 mm at a point at 200 mm from the center of each long side and at any other points off the long sides.

The skirt portions 24 of the auxiliary mask 20 are provided with the beads 25, and the beads 18 and 25 have the aforesaid configuration. Therefore, the restraint of the dislocation of the two masks can be reconciled with the improvement of formability of the curved surface. Accordingly, the positional accuracy of the apertures of the two masks can be secured even after the masks are press-formed in a fixed state. Thus, there may be obtained the color cathode ray tube, which is furnished with the shadow mask having adequate curved mask surface strength and enjoys a satisfactory image quality level, and the method of manufacturing the same.

Figure 13:
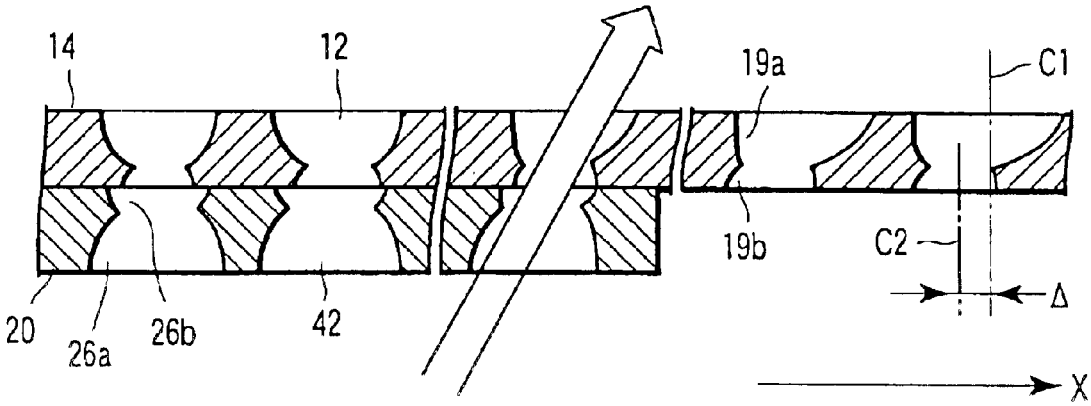
FIG. 13 is a sectional view showing a shadow mask of a color cathode ray tube according to an alternative embodiment of this invention.

This invention is not limited to the embodiment described above, and various modifications may be effected therein without departing from the scope of the invention. In the embodiment described above, for example, the auxiliary mask 20 is located on the phosphor screen side of the main mask 14. As shown in FIG. 13, however, the auxiliary mask 20 may be located on the electron gun side of the main mask 14 with the same functions and effects as aforesaid.

Further, a plurality of auxiliary masks may be provided without being limited to one in number. According to the foregoing embodiment, furthermore, the width and height of the beads in the superposed portion of the shadow mask are smaller than the width and height of the beads in the non-superposed portions. However, the same functions and effects of the foregoing embodiment can be obtained by making the width or height of the former smaller than the width or height of the beads in the non-superposed portions.

What is claimed is:

1. A color cathode ray tube comprising:

a panel having a phosphor screen on an inner surface thereof;

an electron gun which emits electron beams toward the phosphor screen; and a substantially rectangular shadow mask located opposite the phosphor screen inside the panel and having a major axis and a minor axis extending at right angles to each other and to a tube axis, the shadow mask including a main mask opposed substantially to the whole area of the phosphor screen and having a number of electron beam passage apertures, and an auxiliary mask fixedly lapped on the main mask in a region containing the minor axis and having a plurality of electron beam passage apertures corresponding to a part of the phosphor screen, the main mask including an effective portion formed having the electron beam passage apertures, a nonporous portion situated around the effective portion, a skirt portion, and first beads located substantially covering the whole circumference of the skirt portion, the auxiliary mask including a porous portion formed having the electron beam passage apertures, nonporous portions continuous individually with the opposite ends of the porous portion in the direction of the minor axis, a pair of skirt portions extending individually from the nonporous portions and superposed on the skirt portion of the main mask, and second beads formed individually on the skirt portions and situated overlapping the first beads of the main mask, and the height or width of the first and second beads in a superposed portion in which the main mask and the auxiliary mask overlap each other being different from that of the beads in non-superposed portions outside the superposed portion.

2. A color cathode ray tube according to claim 1, wherein the height or width of the first and second beads in the superposed portion is smaller than that of the beads in the non-superposed portions.

3. A color cathode ray tube according to claim 1, wherein the width or height of the beads formed in the non-superposed portions of the skirt portion on the long sides of the shadow mask increases with distance from the superposed portion.

4. A color cathode ray tube according to claim 2, wherein the width or height of the beads formed in the non-superposed portions of the skirt portion on the long sides of the shadow mask increases with distance from the superposed portion.

5. A method of manufacturing a color cathode ray tube, which comprises a panel having a phosphor screen on an inner surface thereof, an electron gun which emits electron beams toward the phosphor screen, and a substantially rectangular shadow mask located opposite the phosphor screen inside the panel and having a major axis and a minor axis extending at right angles to each other and to a tube axis, the shadow mask including a main mask opposed substantially to the whole area of the phosphor screen and having a number of electron beam passage apertures and an auxiliary mask fixedly lapped on the main mask in a region containing the minor axis and having a plurality of electron beam passage apertures corresponding to a part of the phosphor screen, the main mask including an effective portion having the electron beam passage apertures, a non-porous portion situated around the effective portion, a skirt portion extending from the nonporous portion, and first beads located substantially covering the whole circumference of the skirt portion, and the auxiliary mask including a porous portion having the electron beam passage apertures, nonporous portions continuous individually with the opposite ends of the porous portion in the direction of the minor axis, a pair of skirt portions extending individually from the nonporous portions and superposed on the skirt portion of the main mask, and second beads formed individually on the skirt portions and situated overlapping the first beads of the main mask, the method comprising:

preparing a flat first mask base for the main mask including an effective portion having a number of electron beam passage apertures, and a flat second mask base for the auxiliary mask including a porous portion having a number of electron beam passage apertures;

lapping the second mask base on a region containing the minor axis of the first mask base;

fixing the lapped first and second mask bases to each other after positioning the first and second mask bases with respect to each other;

press-forming the fixed first and second mask bases into a given shape with the respective peripheral portions of the first and second mask bases held to form the first and second beads, thereby forming the shadow mask having the main mask and the auxiliary mask; and differentiating the height or width of the first and second beads in a superposed portion in which the main mask and the auxiliary mask are superposed on each other from that of the beads in non-superposed portions outside the superposed portion in forming the first and second beads.

6. A method of manufacturing a color cathode ray tube according to claim 5, wherein the height or width of the first and second beads in the superposed portion is made smaller than that of the beads in the non-superposed portions.

7. A method of manufacturing a color cathode ray tube according to claim 5, wherein the first beads in the non-superposed portions of the skirt portion on the long sides of the shadow mask are formed so that the width or height thereof increases with distance from the superposed portion.

8. A method of manufacturing a color cathode ray tube according to claim 6, wherein the first beads in the non-superposed portions of the skirt portion on the long sides of the shadow mask are formed so that the width or height thereof increases with distance from the superposed portion.

* * * * *